US007976340B1

(12) United States Patent
Saraswat et al.

(10) Patent No.: US 7,976,340 B1
(45) Date of Patent: Jul. 12, 2011

(54) CONNECTOR SYSTEM WITH ELECTROMAGNETIC INTERFERENCE SHIELDING

(75) Inventors: Dharmendra Saraswat, Harrisburg, PA (US); Timothy Robert Minnick, Enola, PA (US); Lynn Robert Sipe, Mifflintown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/723,206

(22) Filed: Mar. 12, 2010

(51) Int. Cl.
*H01R 13/648* (2006.01)

(52) U.S. Cl. ..... 439/607.07; 439/607.3; 439/108

(58) Field of Classification Search ..... 439/607.05–607.19, 108, 607.3
See application file for complete search history.

(56) References Cited

U.S. PATENT DOCUMENTS 4,737,123 A * 4/1988 Paler et al. ..... 439/607.18
5,161,999 A * 11/1992 Broschard et al. ..... 439/567
5,167,531 A * 12/1992 Broschard et al. ..... 439/541.5
5,215,473 A * 6/1993 Brunker et al. ..... 439/108
6,309,742 B1 * 10/2001 Clupper et al. ..... 428/304.4
6,471,549 B1 10/2002 Lappöhn
6,506,076 B2 1/2003 Cohen et al.
6,602,095 B2 8/2003 Astbury, Jr. et al.
6,672,902 B2 * 1/2004 Skinner et al. ..... 439/607.01
6,913,490 B2 7/2005 Whiteman, Jr. et al.
7,135,643 B2 * 11/2006 van Haaster et al. ..... 174/382
7,267,515 B2 9/2007 Lappöhn
2002/0022401 A1 * 2/2002 Ramey et al. ..... 439/608
2002/0168898 A1 * 11/2002 Billman et al. ..... 439/608
2005/0245133 A1 * 11/2005 Scherer et al. ..... 439/610
2006/0272857 A1 * 12/2006 Arnold ..... 174/377
2010/0041273 A1 * 2/2010 Scherer et al. ..... 439/607.01
2010/0144201 A1 * 6/2010 Defibaugh et al. ..... 439/607.05

* cited by examiner

*Primary Examiner* — Gary F. Paumen

(57) ABSTRACT

A connector system includes a header connector, a mating connector, and a conductive grounding bridge. The header connector includes a conductive shell that defines an interior chamber and a contact disposed in the interior chamber. The mating connector includes a conductive member and an electromagnetic shield joined to a housing. The shield has an elongated protrusion extending from the shield to an outer end. The header connector and the mating connector couple with each other such that the contact engages the conductive member and the protrusion engages the shell. The grounding bridge is joined to one of the header connector and the mating connector and engages another of the header connector and the mating connector when the protrusion engages the shell. The protrusion is electrically coupled with the shell at the outer end of the protrusion and by the grounding bridge.

21 Claims, 5 Drawing Sheets

CONNECTOR SYSTEM WITH ELECTROMAGNETIC INTERFERENCE SHIELDING

BACKGROUND OF THE INVENTION

The subject matter herein relates generally to connector systems having mating connectors, and more particularly, to connector systems that include shielding to restrict emission of electromagnetic interference (EMI).

Known connector systems include connectors that each have contacts that engage each other to communicate data signals between the contacts. Some connector systems include connectors with pairs of contacts that communicate high speed differential signals. The connectors may include conductive shields that attempt to restrict emission of EMI from the contacts outside of the connectors. For example, each of the connectors in a connector system may include shields that enclose the contacts of the connector. The shields may be electrically joined with a ground reference to transfer the energy of at least some of the EMI to the ground reference. By transferring at least some of the EMI to the ground reference, the shields prevent at least some of the EMI from radiating to other nearby connectors. The EMI that does radiate to nearby mated contacts may induce noise in the signals that are communicated by the mated contacts and thereby degrade the signal to noise ratio of the mated contacts.

Some known shields include elongated protrusions or tongues that engage the shield of another connector. For example, a first connector may have a shield with a protrusion that is received in the shield of a second connector to electrically couple the two shields with each other. The protrusion may extend to an outer end that engages the shield of the other connector in order to electrically couple the shields. But, the protrusion may only contact the shield of the other connector at the outer end of the protrusion. This may leave an overhanging portion of the shield between the point of contact with the protrusion and the front end of the shield to act as an antenna. As a result, EMI energy received by the overhanging portion of the shield from the contacts in the connectors may oscillate along the length of the overhanging portion. For example, the energy of the EMI may oscillate between the point of contact of the protrusion with the shield and the front end of the shield along the overhang portion of the shield. The oscillation of the EMI energy may cause the shield to behave as an antenna. For example, the shield may radiate the EMI similar to an antenna radiating a wireless data signal. The radiated EMI can interfere with data signals being communicated using other nearby connectors.

Some other known shields have sidewalls that extend from the shield to exposed edges. The exposed edges may not be coupled or joined with any other conductive body or shield. As a result, EMI energy that is transferred to the sidewalls may oscillate along the sidewalls between the exposed edges and the remainder of the shield. As described above, the oscillating EMI energy may cause the sidewalls to radiate the EMI similar to an antenna.

Thus, a need exists for a connector system that restricts the radiation of EMI from the shields of the connector system.

BRIEF DESCRIPTION OF THE INVENTION

In one embodiment, a connector system is provided. The connector system includes a header connector, a mating connector, and a conductive grounding bridge. The header connector includes a conductive shell that defines an interior chamber and a contact disposed in the interior chamber. The mating connector includes a conductive member and an electromagnetic shield joined to a housing. The shield has an elongated protrusion extending from the shield to an outer end. The header connector and the mating connector couple with each other such that the contact engages the conductive member and the protrusion engages the shell. The grounding bridge is joined to one of the header connector and the mating connector and engages another of the header connector and the mating connector when the protrusion engages the shell. The protrusion is electrically coupled with the shell at the outer end of the protrusion and by the grounding bridge.

In another embodiment, a connector is provided. The connector includes a conductive shell, a contact, and a grounding bridge. The conductive shell includes sidewalls and a coupling wall that partially bound an interior chamber of the shell. The sidewalls and coupling wall extend to outer edges. The contact is disposed in the interior chamber of the shell. The grounding bridge is joined to the shell and protrudes from at least one of the outer edges. The shell receives an elongated protrusion of an electromagnetic shield of a mating connector. The shell and the grounding bridge are electrically coupled with the protrusion in spaced apart locations when a conductive member of the mating connector couples with the contact.

In another embodiment, another connector system is provided. The system includes a header connector, a mating connector, and an absorptive gasket. The header connector includes a conductive shell that extends to a front face. The shell defines an interior chamber with a contacts disposed therein. The mating connector includes a conductive member and an electromagnetic shield joined to a housing. The shield has an elongated protrusion extending from the shield. The header connector and the mating connector couple with each other such that the contacts engage the conductive member and the protrusion is received in the interior chamber through the front face. The gasket is joined to at least one of the header connector and the mating connector such that the gasket is disposed between the front face of the shell of the header connector and the housing of the mating connector when the header connector and mating connector couple with each other. The gasket absorbs electromagnetic interference emitted from at least one of the contacts and the conductive member.

DETAILED DESCRIPTION OF THE INVENTION

Figure 1:
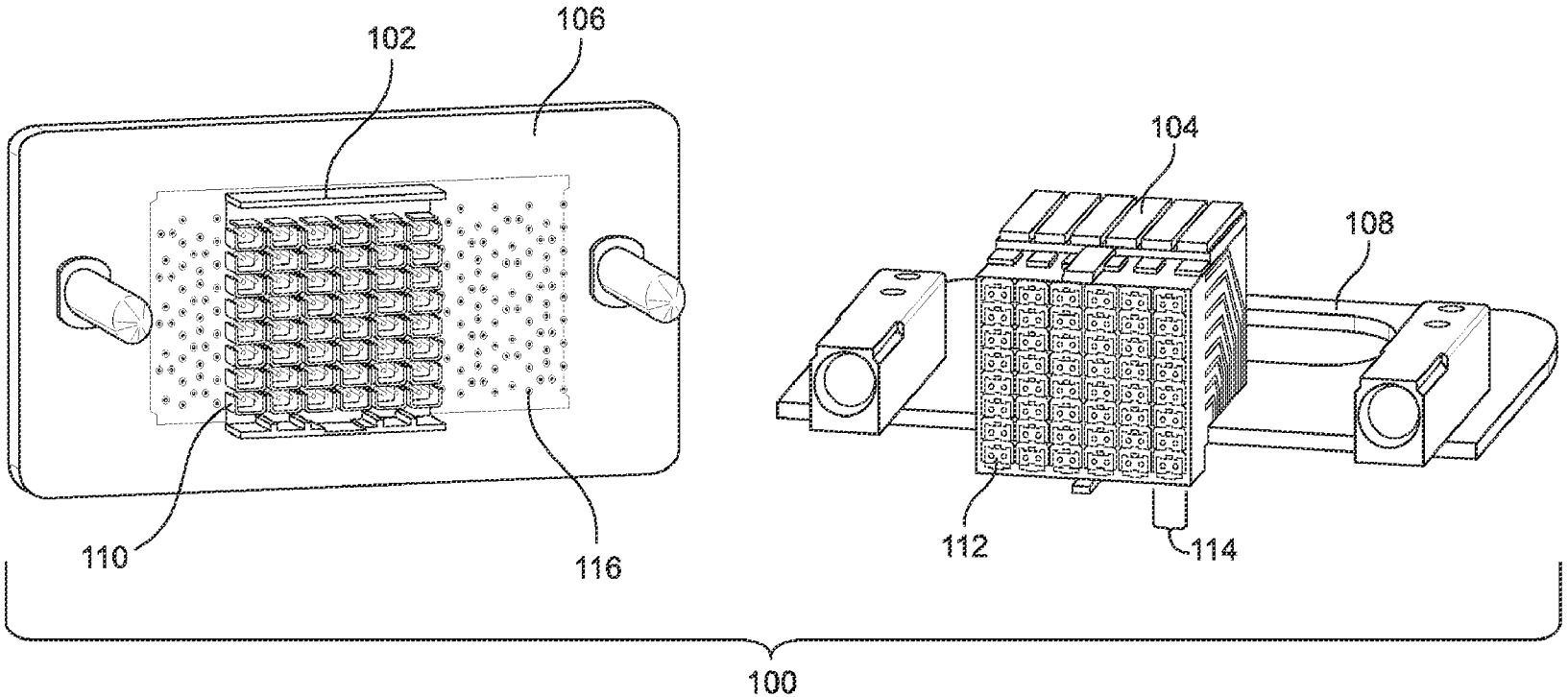
FIG. 1 is a perspective view of a connector system in accordance with one embodiment.

FIG. 1 is a perspective view of a connector system 100 in accordance with one embodiment of the present disclosure.

The connector system 100 includes two connector assemblies 102, 104 that mate with each other to electrically couple two circuit boards 106, 108. In the illustrated embodiment, the connector assembly 102 includes several connectors 110 that may be referred to as header connectors and the connector assembly 104 includes several connectors 112 that may be referred to as mating connectors. Alternatively, the connectors 110 may be connectors other than header connectors. The connector assembly 104 includes several chicklets 114 joined side-by-side. The chicklets 114 include separate groups of the mating connectors 112 linearly aligned with one another.

The header connectors 110 are mounted to the circuit board 106 while the mating connectors 112 are mounted to the circuit board 108. The circuit board 106 may be a backplane circuit board while the circuit board 108 may be a motherboard. The circuit boards 106, 108 include several plated vias 116 that are electrically coupled with conductive traces (not shown) in the circuit boards 106, 108 to electrically join the header and mating connectors 110, 112 with other devices, components, and/or ground references via the circuit boards 106, 108.

While one or more embodiments of the present disclosure are described in terms of the connector assemblies 102, 104 shown in FIG. 1, not all embodiments are limited to the connector assemblies 102, 104. One or more embodiments may be used with connectors other than the header and mating connectors 110, 112 and the connector assemblies 102, 104.

Figure 2:
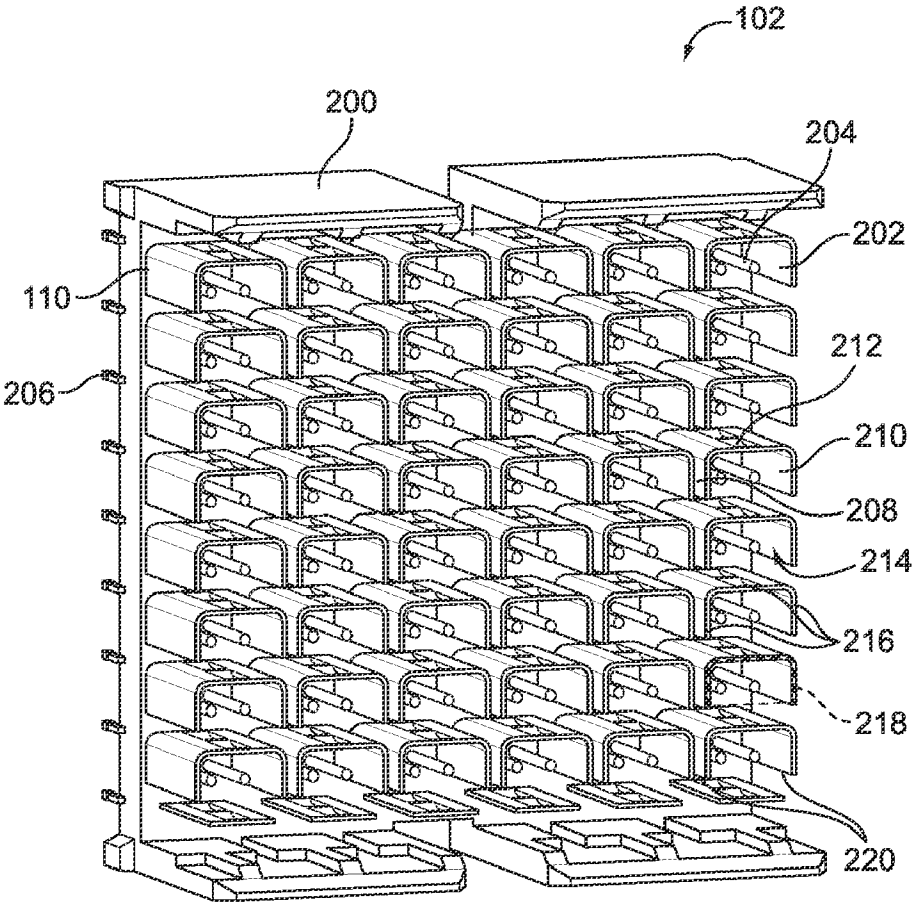
FIG. 2 is a perspective view of a connector assembly shown in FIG. 1 in accordance with one embodiment.

FIG. 2 is a perspective view of the connector assembly 102 in accordance with one embodiment. The connector assembly 102 includes a housing 200 that may be mounted to a circuit board, such as the circuit board 106 (shown in FIG. 1). In the illustrated embodiment, the header connectors 110 of the connector assembly 102 are linearly aligned with one another in several rows and columns. Each of the header connectors 110 shown in FIG. 2 includes a conductive shell 202 and two contacts 204. The shell 202 is joined to the housing 200 and is electrically coupled with the circuit board 106 (shown in FIG. 1). For example, the shell 202 may have a pin 206 that extends through and projects from the housing 200. The pin 206 may be received in a plated via 116 (shown in FIG. 1) in the circuit board 106 (shown in FIG. 1) that is electrically joined with a ground reference. As shown in FIG. 2, the shell 202 has a U-shape and partially encloses the contacts 204 by extending around the contacts 204 on three sides of the contacts 204. The shell 202 may conduct electromagnetic interference radiating from the contacts 204 to a ground reference by way of the pin 206 and vias 116 in the circuit board 106.

In the illustrated embodiment, the shell 202 includes opposing sidewalls 208, 210 that are interconnected by a coupling wall 212. The sidewalls 208, 210 are oriented perpendicular to the coupling wall 212 and thereby give the shell 202 a U-shape. Alternatively, the shell 202 may include a different number of sidewalls 208, 210 and/or coupling walls 212 and may have a different shape. For example, the shell 202 may have a rectangular shape that encircles the contacts 204. The shell 202 may be formed from a common sheet of conductive material. For example, the shell 202 may be stamped and formed from a sheet of a metal or metal alloy. The sidewalls 208, 210 and the coupling wall 212 extend to outer edges 216. The sidewalls 208, 210 extend from the coupling wall 212 to lower edges 220. As shown in FIG. 2, the lower edges 220 are oriented approximately perpendicular to the outer edges 216. The outer edges 216 of the sidewalls 208, 210 and the coupling wall 212 define a front face 218 of the shell 202. As described below, the mating connectors 112 (shown in FIG. 1) are received into the shell 202 through the front face 218 to couple the mating connectors 112 with the header connectors 110.

The shell 202 defines an interior chamber 214 in which the contacts 204 are disposed. The interior chamber 214 is bounded on three sides by the sidewalls 208, 210 and the coupling wall 212. The interior chamber 214 may extend from the sidewall 208 to the sidewall 210 and from the coupling wall 212 to a plane that is oriented parallel to the coupling wall 212. For example, the interior chamber 214 may extend from the coupling wall 212 to a plane that includes the lower edges 220 of the sidewalls 208, 210.

The contacts 204 are arranged in pairs in the interior chamber 214 of the shell 202 in the illustrated embodiment. The contacts 204 may communicate a high-speed differential signal. The contacts 204 are joined to the housing 200 and may extend through the housing 200 and protrude from the housing 200 in a manner similar to the pins 206 of the shells 202. Alternatively, the contacts 204 may be provided in a different number or arrangement than is shown in FIG. 2.

Figure 3:
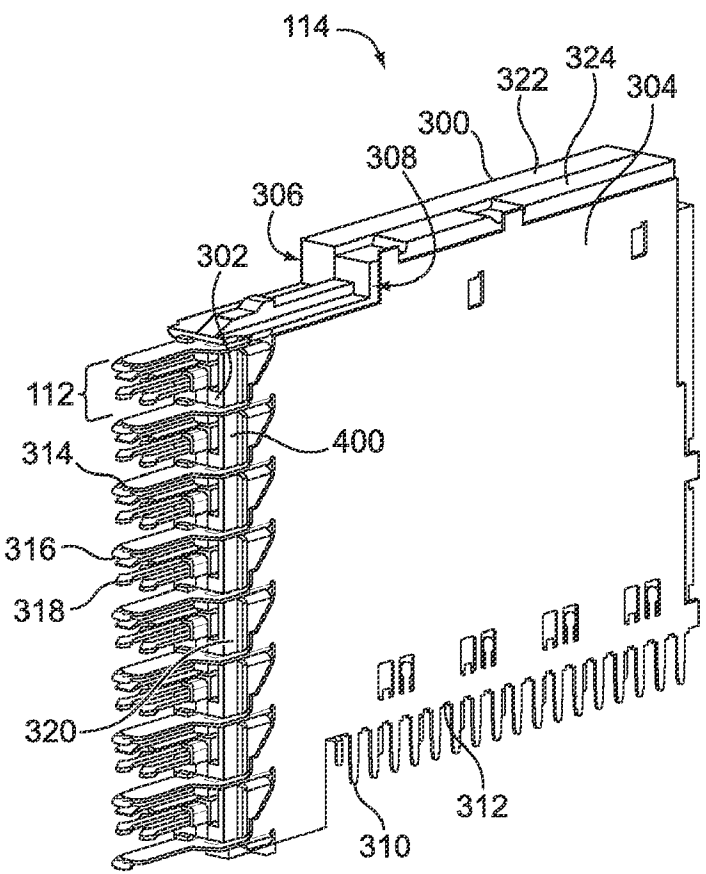
FIG. 3 is a perspective view of a chicklet of the connector assembly shown in FIG. 1 in accordance with one embodiment.

FIG. 3 is a perspective view of one of the chicklets 114 of the connector assembly 104 shown in FIG. 1 in accordance with one embodiment. The chicklet 114 includes a housing 300 that has a substantially planar form. The housing 300 may include or be formed from a dielectric material, such as one or more polymers. Alternatively, the housing 300 may include or be formed from a conductive material, such as one or more metals or metal alloys. The housing 300 may include an exterior shell or plating of a conductive material. For example, the housing 300 may be a dielectric body that includes a conductive plating on all or a portion of the exterior of the housing 300. In the illustrated embodiment, the housing 300 includes two bodies 322, 324 that are joined together. Alternatively, the housing 300 may be formed as a unitary body or may be formed of more than two bodies. The chicklet 114 includes several mating connectors 112 linearly aligned with one another along a front side 302 of the chicklet 114.

The chicklet 114 includes an electromagnetic shield 304 that extends along opposite sides 306, 308 of the housing 300. The shield 304 includes or is formed from a conductive material, such as metal or a metal alloy. The shield 304 may be electrically coupled with the housing 300, such as an exterior conductive plating of the housing 300. The conductive plating may abut the shield 304 to electrically join the plating with the housing 300. The shield 304 has pins 310 that protrude from the shield 304 along a bottom side 312 of the chicklet 114. In the illustrated embodiment, the bottom side 312 of the chicklet 114 is approximately perpendicular to the front side 302. The pins 310 may be inserted into plated vias 116 (shown in FIG. 1) of the circuit board 108 (shown in FIG. 1) to electrically couple the shield 304 with a ground reference of the circuit board 108 or by way of the circuit board 108.

The shield 304 includes elongated protrusions 314 that forwardly project from the front side 302 of the chicklet 114. The protrusions 314 extend to outer ends 316. In the illustrated embodiment, each mating connector 112 that is included in the connector assembly 104 (shown in FIG. 1) includes one of the protrusions 314. Alternatively, the mating connectors 112 may include more protrusions 314.

Also as shown in FIG. 3, each mating connector 112 includes two conductive members 318. The conductive members 318 may be receptacle contacts that receive the contacts 204 (shown in FIG. 2) of the header connectors 110 (shown in FIG. 1) when the header connectors 110 mate with the mating connectors 112. For example, the conductive members 318 in each mating connector 112 may be conductive receptacles that receive the contacts 204 to enable communication of differential signals between the header connectors 110 and the mating connectors 112. Alternatively, the conductive members 318 may be arranged differently. For example, the mating connectors 112 may include a different number of conductive members 318 and/or the conductive members 318 may engage or couple with the contacts 204 without receiving the contacts 204. Forward portions 400 of the housing 300 are located between the front side 302 of the chicklet 114 and the shield 304. The forward portions 400 may include the sections of the housing 300 that are exposed between the front side 302 of the chicklet 114 and the shield 304.

Figure 4:
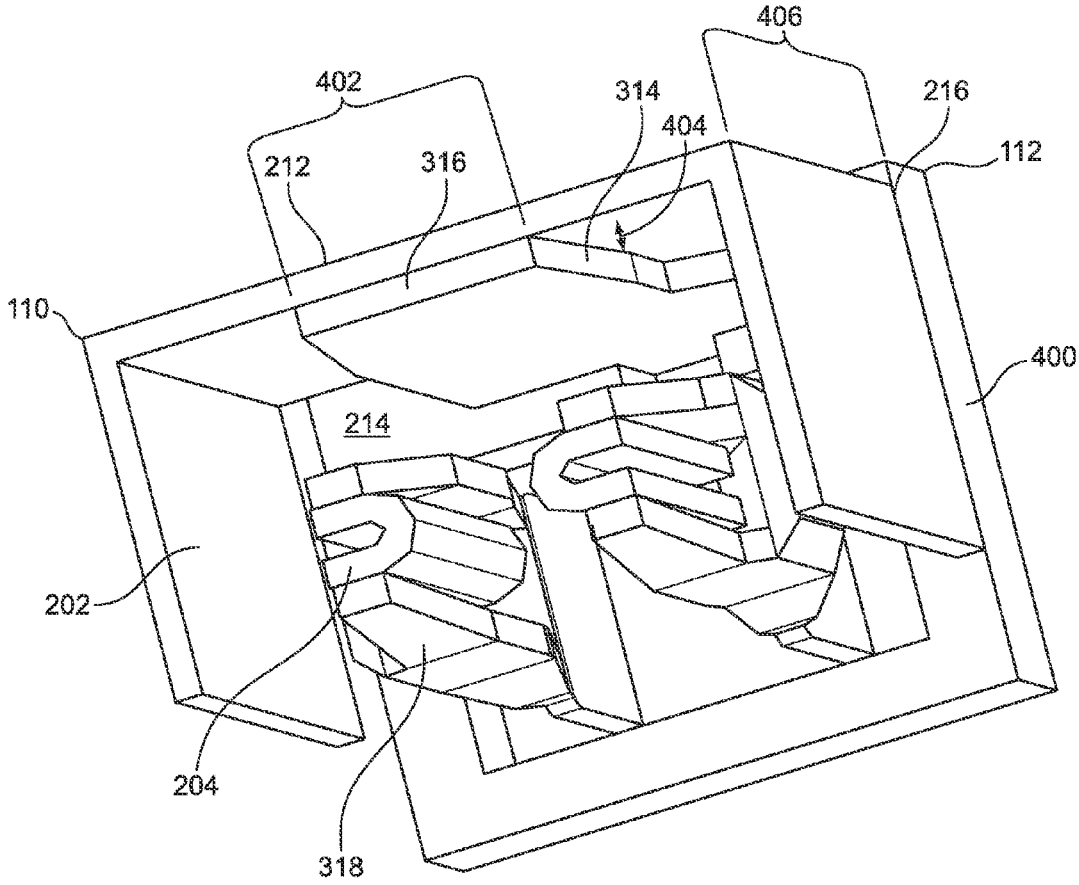
FIG. 4 is a perspective view of a header connector shown in FIG. 1 coupled with a mating connector also shown in FIG. 1 in accordance with one embodiment.

FIG. 4 is a perspective view of the header connector 110 receiving the mating connector 112 in accordance with one embodiment. Only the shell 202 and portions of the contacts 204 of the header connector 110 are shown in FIG. 4 to more clearly illustrate the interaction of the header and mating connectors 110, 112. Additionally, only the conductive members 318, the protrusion 314 of the shield 304 (shown in FIG. 3), and the forward portions 400 of the housing 300 (shown in FIG. 3) are shown in FIG. 4 for the mating connector 112.

The contacts 204 are received in the conductive members 318 to electrically couple the header connector 110 with the mating connector 112 in the illustrated embodiment. The protrusion 314 is received in the shell 202 when the conductive members 318 couple with the contacts 204. The outer end 316 of the protrusion 314 engages the shell 202 inside the shell 202, or inside the interior chamber 214. Alternatively, the outer end 316 may be located relative to the shell 202 such that the outer end 316 engages the shell 202 outside the shell 202, such as on the exterior of the shell 202. In one embodiment, the outer end 316 engages the coupling wall 212 of the shell 202 inside the interior chamber 214 when the protrusion 314 is inserted into the interior chamber 214. The location(s) where the outer end 316 engages or abuts the shell 202 inside the shell 202 may be referred to as an engagement interface 402. The outer end 316 may wipe along the coupling wall 212 inside the interior chamber 214 as the protrusion 314 is loaded into the interior chamber 214. The wiping of the outer end 316 along the coupling wall 212 may remove oxidized portions of the coupling wall 212 to provide an improved electrical connection between the coupling wall 212 and the protrusion 314. As a result, the shell 202 may be electrically coupled with the shield 304 (shown in FIG. 3) by way of the engagement between the outer end 316 and the coupling wall 212. The remainder of the protrusion 314 may not engage the coupling wall 212 between the outer end 316 and the forward portion 400 of the housing 300 (shown in FIG. 3). For example, the protrusion 314 may be spaced apart from the shell 202 by a gap 404 between the engagement interface 402 and the edge 216 of the shell 202. The section of the coupling wall 212 between the engagement interface 402 and the edge 216 may be referred to as an overhanging portion 406 of the shell 202.

Figure 5:
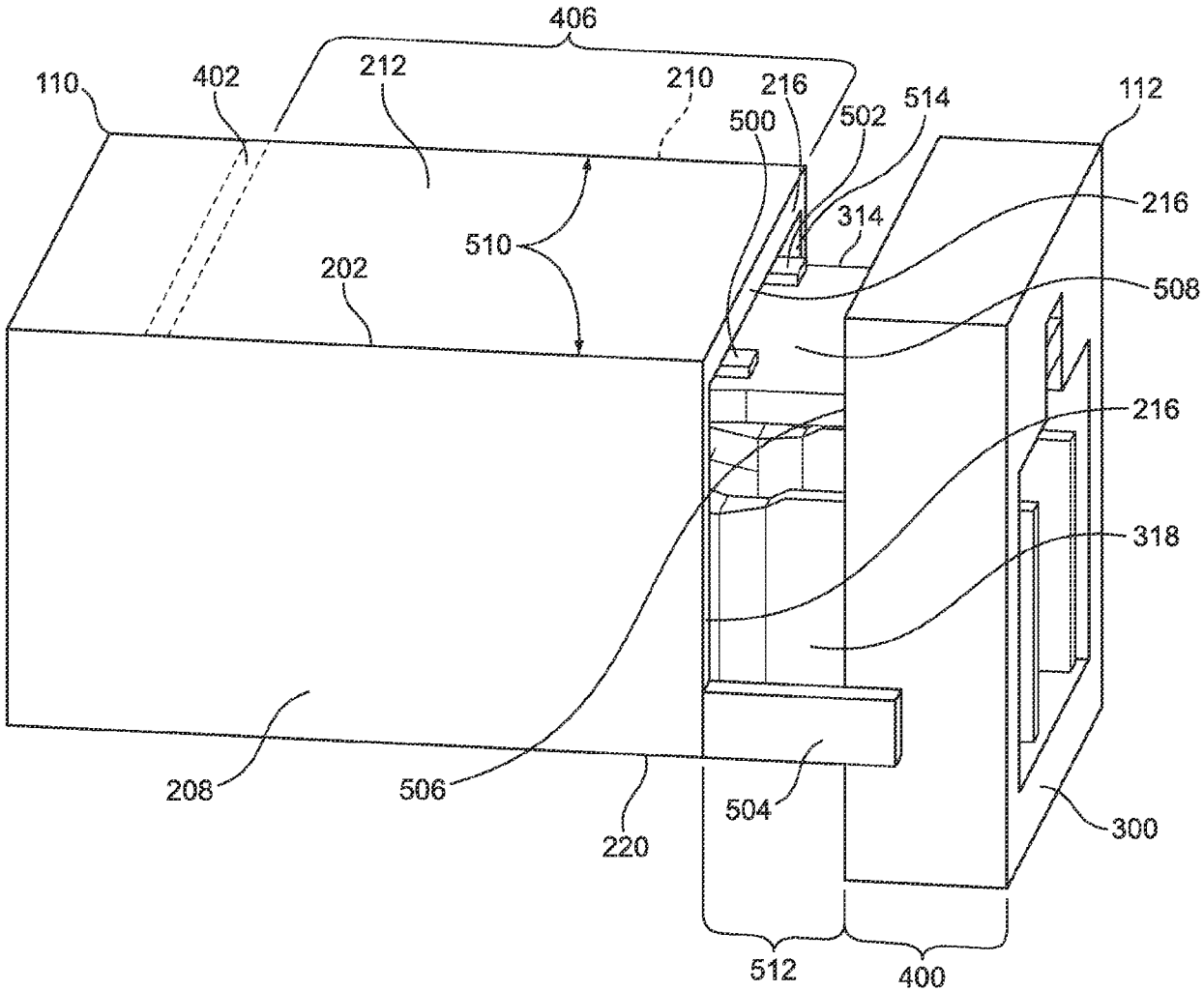
FIG. 5 is another perspective view of the header connector shown in FIG. 1 coupled with the mating connector also shown in FIG. 1 in accordance with one embodiment.

FIG. 5 is another perspective view of the header connector 110 coupled with the mating connector 112 in accordance with one embodiment. The header connector 110 includes several grounding bridges 500, 502, 504 that are joined to the shell 202. Alternatively, one or more of the grounding bridges 500, 502, 504 may be coupled to the mating connector 112. For example, the grounding bridges 500, 502 may be joined to the protrusion 314 and the grounding bridge 504 may be coupled to the forward portion 400 of the housing 300. Although not visible in FIG. 5, another grounding bridge that is similar to the grounding bridge 504 may mirror the illustrated grounding bridge 504 and be provided on the opposite side of the header connector 110 or mating connector 112. In another embodiment, less than all of the grounding bridges 500, 502, 504 may be included in the mating connector 112 and/or header connector 110. For example, the grounding bridges 500, 502 or the grounding bridges 504 may be excluded. In another embodiment, a grounding bridge that extends around all or a portion of the interface between the header connector 110 and the mating connector 112. For example, a single grounding bridge may extend from each of the edges 216 to couple with the mating connector 112.

The grounding bridges 500, 502, 504 are conductive bodies that form an electrically conductive pathway between the mating connector 112 and the header connector 110. In the illustrated embodiment, the grounding bridges 500, 502 forwardly project from the outer edge 216 of the coupling wall 212. For example, the grounding bridges 500, 502 may be extensions of the coupling wall 212 or may be fixed to the coupling wall 212 such that the grounding bridges 500, 502 protrude from the outer edge 216. The grounding bridges 500, 502 engage the protrusion 314 of the shield 304 (shown in FIG. 3) outside of the shell 202 when the protrusion 314 is inserted into the shell 202. The grounding bridges 500, 502 engage the protrusion 314 in a location that is spaced apart from the engagement between the outer end 316 (shown in FIG. 3) of the protrusion 314 and the shell 202 inside the shell 202. For example, the grounding bridges 500, 502 may engage and provide conductive pathways between the protrusion 314 and the shell 202 in locations that are closer to the forward portion 400 of the housing 300 than the outer end 316 of the protrusion 314. The grounding bridges 500, 502 may provide the conductive pathways closer to an interface 506 between the protrusion 314 and the forward portion 400 of the housing 300. Alternatively, the grounding bridges 500, 502 may be fixed to the protrusion 314 and may engage the shell 202 when the protrusion 314 is inserted into the shell 202. For example, the grounding bridges 500, 502 may be joined to an upper surface 508 of the protrusion 314 such that the grounding bridges 500, 502 engage the coupling wall 212 at the outer edge 216 of the coupling wall 212 when the protrusion 314 is loaded into the shell 202. As shown in FIG. 5, the grounding bridges 500, 502 engage the shell 202 in locations that are spaced apart from the engagement interface 402 between the protrusion 314 and the shell 202.

EMI may emanate from the contacts 204 (shown in FIG. 2) and the conductive members 318. For example, EMI may be generated when high speed differential signals are communicated between the contacts 204 and the conductive members 318. The energy of the EMI may be transferred to an inner surface 514 of the coupling wall 212 and/or to the protrusion 314. The EMI energy on the coupling wall 212 between (1) the engagement interface 402 between the protrusion 314 and the coupling wall 212 and (2) the outer edge 216 of the shell 202 may not have any conductive pathway to transfer the energy out of the coupling wall 212. As a result, the EMI energy in the coupling wall 212 may oscillate back and forth between the engagement interface 402 and the outer edge 216 of the coupling wall 212. This oscillation may result in the overhanging portion 406 of the coupling wall 212 to function as an antenna that radiates the energy of the EMI. The radiating EMI can induce noise from differential signals being communicated by contacts 204 and conductive members 318 on the nearby header and mating connectors 110, 112.

In order to prevent the EMI from radiating from the overhanging portion 406 of the shell 202, the grounding bridges 500, 502 provide additional couplings between the protrusion 314 and the shell 202 in order to transfer the EMI out of the coupling wall 212 of the shell 202 and prevent oscillation of the energy of the EMI in the coupling wall 212. The grounding bridges 500, 502 establish additional conductive pathways that are paths for the EMI to be transferred to the shield 304. The EMI in the coupling wall 212 may be prevented from oscillating back and forth along the overhanging portion 406 of the shell 202 as the energy of the EMI is conducted to the shield 304 (FIG. 3).

The grounding bridges 504 forwardly project from the outer edges 216 of the sidewalls 208, 210 in the illustrated embodiment. For example, the grounding bridges 504 may be extensions of the sidewalls 208, 210 or may be fixed to the sidewalls 208, 210 such that the grounding bridges 504 protrude from the outer edges 216. The grounding bridges 504 engage the forward portion 400 of the housing 300 when the protrusion 314 is inserted into the shell 202. The shell 202 of the header connector 110 and the forward portion 400 of the housing 300 of the mating connector 112 may be separated by a gap 512 when the contacts 204 (shown in FIG. 2) and conductive members 318 mate with one another. The grounding bridges 504 may span this gap 512 in order to provide electrically conductive pathways between the shell 202 and the forward portion 400 of the housing 300 across the gap 512. As described above, the exterior of the housing 300 may include a conductive plating. The grounding bridges 504 may engage this plating to electrically couple the shell 202 with the housing 300. In the illustrated embodiment, the grounding bridges 504 engage the housing 300 in locations that are spaced apart from the grounding bridges 500, 502 and the engagement interface 402 between the protrusion 314 and the shell 202.

The grounding bridges 504 engage the forward portion 400 of the housing 300 in locations that are spaced apart from interfaces 510 between the sidewalls 208, 210 and the coupling wall 212. The interfaces 510 represent the intersections of the sidewalls 208, 210 and the coupling wall 212. The grounding bridges 504 may be located at or near the lower edges 220 of the sidewalls 208, 210 in order to provide conductive pathways between the sidewalls 208, 210 and the forward portion 400 of the housing 300 of the mating connector 112. Alternatively, the grounding bridges 504 may be located in a different position on the sidewalls 208, 210. For example, the grounding bridges 504 may be located closer to the interfaces 510 than what is shown in the embodiment of FIG. 5.

In another embodiment, the grounding bridges 504 may be fixed to the forward portion 400 of the housing 300 of the mating connector 112 and engage the sidewalls 208, 210 when the protrusion 314 is loaded into the shell 202. For example, the grounding bridges 504 may forwardly project from the housing 300 such that the grounding bridges 504 engage the sidewalls 208, 210 at or near the outer edges 216 of the sidewalls 208, 210 when the protrusion 314 is loaded into the shell 202.

As described above, EMI may emanate from the contacts 204 and the conductive members 318. Some of the energy of the EMI may be transferred to the sidewalls 208, 210 of the shell 202. Without additional conductive pathways between the sidewalls 208, 210 and the mating connector 112, some of the energy of the EMI may oscillate back and forth along the sidewalls 208, 210 between the interfaces 510 and the lower edges 220 of the sidewalls 208, 210. This oscillation may result in the sidewalls 208, 210 functioning as antennas that radiate the energy of the EMI. The radiating electromagnetic interference can induce noise from differential signals being communicated by contacts 204 and conductive members 318 on the nearby header and mating connectors 110, 112.

The grounding bridges 504 provide additional couplings between the sidewalls 208, 210 and the mating connector 112 in order to transfer the EMI out of the sidewalls 208, 210 and prevent oscillation of the energy of the EMI in the sidewalls 208, 210. The grounding bridges 504 establish additional conductive pathways that are paths for the EMI to be transferred to the forward portion 400 of the housing 300 of the mating connector 112. The EMI in the sidewalls 208, 210 may not be permitted to oscillate back and forth along the sidewalls 208, 210 between the interfaces 510 and the lower edges 220 as the energy of the EMI is conducted to the forward portion 400 of the mating connector 112. The energy of the EMI may be conducted through the forward portion 400 of the housing 300 of the mating connector 112 to the shield 304.

Figure 6:
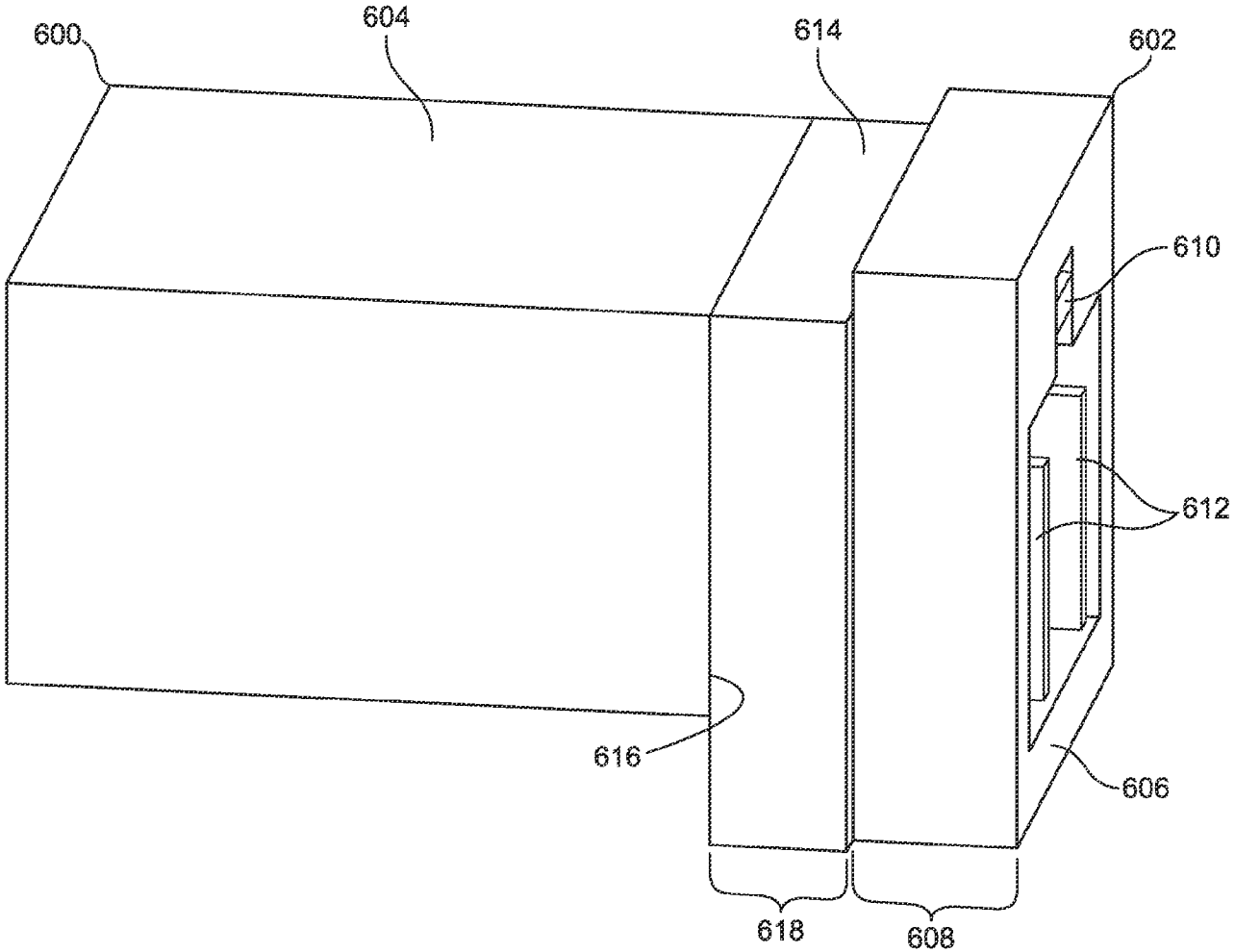
FIG. 6 is a perspective view of a header connector coupled with a mating connector in accordance with another embodiment of the present disclosure.

FIG. 6 is a perspective view of a header connector 600 coupled with a mating connector 602 in accordance with another embodiment of the present disclosure. The header connector 600 may be similar to the header connector 110 (shown in FIG. 1) and the mating connector 602 may be similar to the mating connector 112 (shown in FIG. 1). For example, the header connector 600 includes a conductive shell 604 and contacts (not shown) disposed within the shell 604 that are shaped and dimensioned similar to the shell 202 (shown in FIG. 2) and contacts 204 (shown in FIG. 2) of the header connector 110. The mating connector 602 may include a housing 606 having a forward portion 608 that are similar to the housing 300 (shown in FIG. 3) and the forward portion 400 (shown in FIG. 4). The mating connector 602 also may include an electromagnetic shield (not shown) having an elongated protrusion 610 that are similar to the shield 304 (shown in FIG. 3) and the protrusion 314 (shown in FIG. 3). The mating connector 602 includes conductive members 612 that engage the contacts of the header connector 600 to communicate data signals between the header connector 600 and the mating connector 602.

In the illustrated embodiment, the header connector 600 and the mating connector 602 do not include the grounding bridges 500, 502, 504 shown in FIG. 5 and described above. In order to prevent EMI from radiating from the contacts (not shown) and conductive members 612, an absorptive gasket 614 is disposed between the shell 604 of the header connector 600 and the forward portion 608 of the housing 606 of the mating connector 602. As shown in FIG. 6, the gasket 614 extends between a front face 616 of the shell 604 to the forward portion 608 of the housing 606 when the header connector 600 is coupled with the mating connector 602. The gasket 614 may be fixed to the shell 604 and extend around at least a portion the front face 616 of the shell 604 or may be fixed to the forward portion 608 of the housing 606 such that the gasket 614 engages both the shell 604 and the housing 606 at the same time. The gasket 614 may frame the front face 616 of the shell 604 such that the protrusion 610 and the conductive members 612 extend through and are at least partially encircled by the gasket 614 when the protrusion 610 and conductive members 612 are received into the shell 604.

The gasket 614 includes, or is formed from, one or more materials that absorb energy that is radiated from the contacts (not shown) of the header connector 600 and/or from the conductive members 612 of the mating connector 602. The material(s) of the gasket 614 may be capable of absorbing high-frequency EMI energy radiating from the contacts and/or conductive members 612 in order to restrict emission of the EMI outside of the header connector 600 and the mating connector 602 through a gap 618 located between the header connector 600 and the mating connector 602. By way of example only, the gasket 614 may include or be formed from one or more of a broadband or reticulated foam that includes urethane, such as RFRET foam produced by Laird Technologies, or a carbon-based material or film, such as the carbon fiber films produced by Techfilm, LLC. The gasket 614 may include or be formed of materials that are electrically lossy. For example, the gasket 614 may be formed from RF lossy materials that absorb, rather than conduct, the energy of EMI that radiates from the contacts and/or conductive members 612. Alternatively, the gasket 614 may be formed in a different shape, such as an elongated strip or bar. For example, the gasket 614 may have a shape similar to one or more of the grounding bridges 500, 502, 504 (shown in FIG. 5).

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a header connector comprising a conductive shell that defines an interior chamber and a contact disposed in the interior chamber;

a mating connector comprising a conductive member and an electromagnetic shield joined to a housing, the shield having an elongated protrusion extending from the shield to an outer end, the header connector and the mating connector coupling with each other such that the contact engages the conductive member and the protrusion engages the shell; and a conductive grounding bridge joined to one of the header connector and the mating connector and engaging another of the header connector and the mating connector when the protrusion engages the shell, the protrusion being electrically coupled with the shell at the outer end of the protrusion and by the grounding bridge.

2. The connector system of claim 1, wherein the shell of the header connector and the grounding bridge engage the protrusion of the mating connector in spaced apart locations to restrict radiation of electromagnetic interference from the shell of the header connector when the protrusion engages the shell.

3. The connector system of claim 1, wherein the outer end of the protrusion of the mating connector engages and is electrically coupled with the shell of the header connector and the grounding bridge electrically couples the protrusion and the shell in spaced apart locations when the header connector couples with the mating connector.

4. The connector system of claim 1, wherein the shell of the header connector includes sidewalls interconnected by a coupling wall that extend to outer edges, the grounding bridge electrically coupling the shell with the shield of the mating connector at one or more of the outer edges when the header connector couples with the mating connector.

5. The connector system of claim 1, wherein the shell of the header connector includes sidewalls interconnected by a coupling wall, the sidewalls and the coupling wall extending to outer edges that define a front face through which the protrusion of the mating connector is received into the interior chamber, the sidewalls extending from the coupling wall to lower edges with the grounding bridge extending from the outer edge of at least one of the sidewalls at the lower edge of the at least one of the sidewalls.

6. The connector system of claim 1, wherein the shell of the header connector includes opposing sidewalls interconnected by a coupling wall and the grounding bridge is a first grounding bridge joined to the coupling wall, further comprising second and third grounding bridges joined with the sidewalls, the first, second, and third grounding bridges providing electrically conductive pathways between the shell and the housing of the mating connector when the header connector and the mating connector are coupled.

7. The connector system of claim 1, wherein the grounding bridge is a first grounding bridge, further comprising a second grounding bridge joined to one of the header connector and the mating connector.

8. The connector system of claim 7, wherein the first grounding bridge electrically couples the protrusion of the shield of the mating connector with the shell of the header connector and the second grounding bridge electrically couples the shell with the housing of the mating connector in a position located away from the protrusion when the header connector couples with the mating connector.

9. The connector system of claim 7, wherein the shell of the header connector includes sidewalls interconnected by a coupling wall, the first grounding bridge electrically coupling the coupling wall with the protrusion of the mating connector, the second grounding bridge electrically joining at least one of the sidewalls with the housing of the mating connector when the header connector couples with the mating connector.

10. The connector system of claim 1, wherein the protrusion of the mating connector is electrically coupled to the shell of the header connector by the outer end of the elongated protrusion and the grounding bridge at spaced apart locations when the header connector is coupled with the mating connector.

11. A connector comprising:

a conductive shell including sidewalls and a coupling wall that partially bound an interior chamber of the shell, the sidewalls and the coupling wall extending to outer edges;

a contact disposed in the interior chamber of the shell; and a grounding bridge joined to the shell and protruding from at least one of the outer edges, wherein the shell is engaged by an elongated protrusion of an electromagnetic shield of a mating connector and the shell and the grounding bridge are electrically coupled with the protrusion in spaced apart locations when a conductive member of the mating connector couples with the contact.

12. The connector of claim 11, wherein the shell engages and is electrically coupled with an outer end of the protrusion of the shield and the shell engages and is electrically coupled with the protrusion by the grounding bridge when the shell receives the protrusion.

13. The connector of claim 11, wherein the grounding bridge is a first grounding bridge joined to the coupling wall, further comprising a second grounding bridge joined to one or more of the sidewalls.

14. The connector of claim 13, wherein the first grounding bridge electrically couples the shell with the protrusion of the mating connector and the second grounding bridge electrically couples the shell with a housing of the mating connector in a position spaced apart from the protrusion when the protrusion is received by the shell.

15. The connector of claim 11, wherein the shell and the grounding bridge engage the protrusion of the mating connector in spaced apart locations to restrict radiation of electromagnetic interference from the coupling wall of the shell.

16. The connector of claim 11, wherein the grounding bridge is a first grounding bridge, further comprising second and third grounding bridges joined with the sidewalls with the first grounding bridge joined with the coupling wall, the first, second, and third grounding bridges providing electrically conductive pathways between the shell and the mating connector when protrusion of the mating connector engages the shell.

17. A connector system comprising:

a header connector comprising a conductive shell that extends to a front face, the shell defining an interior chamber with contacts disposed therein;

a mating connector comprising conductive members and an electromagnetic shield joined to a housing, the shield having an elongated protrusion extending from the shield, the header connector and the mating connector coupling with each other such that the contacts engage the conductive members and the protrusion engages the shell; and an absorptive gasket joined to at least one of the header connector and the mating connector such that the gasket is disposed between the front face of the shell of the header connector and the housing of the mating connector when the header connector and mating connector couple with each other, wherein the gasket absorbs electromagnetic interference emitted from at least one of the contacts and the conductive members without electrically conducting the electromagnetic interference between the header connector and the mating connector.

18. The connector system of claim 17, wherein the gasket is coupled with the mating connector and engages the front face of the shell when the mating connector couples with the header connector.

19. The connector system of claim 17, wherein the gasket at least partially frames the interior chamber of the header connector and the protrusion of the mating connector extends through the gasket into the interior chamber when the mating connector couples with the header connector.

20. The connector system of claim 17, wherein the gasket includes a broadband foam.

21. The connector system of claim 17, wherein the gasket is formed from an electrically lossy material that absorbs the electromagnetic interference.

* * * * *